United States Patent [19]

Hirosaki et al.

[11] Patent Number: 4,496,471

[45] Date of Patent: Jan. 29, 1985

[54] STABLE AQUEOUS SOLUTION-TYPE OXIDIZING AGENT COMPOSITION FOR EXPLOSIVES

[75] Inventors: Yoshikazu Hirosaki; Katsuhide Hattori, both of Chita, Japan

[73] Assignee: Nippon Oil and Fats Co., Ltd., Tokyo, Japan

[21] Appl. No.: 441,738

[22] Filed: Nov. 15, 1982

[30] Foreign Application Priority Data

Dec. 10, 1981 [JP] Japan ..... 56-197632

[51] Int. Cl.[3] ..... C06B 31/28

[52] U.S. Cl. ..... 252/186.21; 149/46; 149/75; 149/77; 149/108.8

[58] Field of Search ..... 252/186.21; 149/46, 149/75, 77, 108.8

[56] References Cited

U.S. PATENT DOCUMENTS

| | | | |
|---|---|---|---|
| 3,282,753 | 11/1966 | Cook et al. | 149/46 |
| 4,207,125 | 6/1980 | Grant | 149/44 X |
| 4,331,490 | 5/1982 | Palgrave et al. | 149/46 |
| 4,394,198 | 7/1983 | Takeuchi et al. | 149/2 X |
| 4,398,976 | 8/1983 | Hattori et al. | 149/21 |

*Primary Examiner*—Teddy S. Gron
*Assistant Examiner*—Virginia B. Caress
*Attorney, Agent, or Firm*—Parkhurst & Oliff

[57] ABSTRACT

An aqueous solution-type oxidizing agent composition consisting of an aqueous solution containing an oxidizing agent, which consists of ammonium nitrate as a main component and an inorganic chlorate, and further containing a water-soluble phosphate as a stabilizer, which is stable, inhibits the decomposition of ammonium nitrate, and has high storage stability.

4 Claims, No Drawings

STABLE AQUEOUS SOLUTION-TYPE OXIDIZING AGENT COMPOSITION FOR EXPLOSIVES

BACKGROUND OF THE INVENTION (a) Field of the Invention

The present invention relates to a stable aqueous solution-type oxidizing agent composition consisting of an aqueous solution containing an oxidizing agent, which consists of ammonium nitrate as a main component and an inorganic chlorate, and further containing a phosphate as a stabilizer.

(b) Description of the Prior Art

It has hitherto been known that inorganic chlorate decomposes at high temperature and further its aqueous solution decomposes in the acidic region when in the presence of chlorine ions.

However, there has not been fully investigated the behavior at high temperature of an aqueous solution of an oxidizing agent consisting of ammonium nitrate as a main component and inorganic chlorate.

U.S. Pat. No. 3,282,753 specification discloses the use of sodium carbonate, sodium hydroxide or potassium hydroxide as a stabilizer for improving the storage stability at high temperature of a slurry explosive containing a solution of the above described oxidizing agent.

However, although the decomposition of inorganic chlorate in an explosive can be somewhat suppressed by these stabilizers, ammonium nitrate decomposes gradually to decrease its inherent action as an oxidizing agent. Moreover, in this slurry explosive, inorganic chlorate, ammonium nitrate and the like are dispersed in water to form a water gel, and therefore ammonium nitrate decomposes rapidly. Further, the inorganic chlorate and ammonium nitrate are present in a crystalline form, and therefore the inorganic chlorate decomposes rapidly. While, in a homogeneous aqueous solution of oxidizing agent, wherein ammonium nitrate and inorganic chlorate are completely dissolved in water, even when the above described stabilizer is used, it is difficult to prevent the decomposition of the inorganic chlorate, particularly its decomposition at high temperature, and further it is difficult to suppress the decomposition of ammonium nitrate.

The inventors have found that, when an aqueous solution of an oxidizing agent consisting of ammonium nitrate as a main component and an inorganic chlorate is formed into a very small droplet, that is, formed into a water-in-oil emulsion, the crystallization of the oxidizing agents of inorganic chlorate and ammonium nitrate can be suppressed and the decomposition of the oxidizing agents can be prevented, and have already filed a water-in-oil emulsion explosive composition, wherein the crystallization of the oxidizing agents is suppressed and the decomposition thereof is prevented (Japanese Patent Application No. 2,771/81).

However, although the above described water-in-oil emulsion explosive composition is stable after the explosive composition has been formed, the aqueous solution of the oxidizing agents used for the production of the explosive composition must be kept at high temperature during its storage in order to prevent the crystallization of the oxidizing agents, resulting in the decomposition of the inorganic chlorate. Therefore, the stability, particularly stability at high temperature, of the aqueous solution of the oxidizing agent is still insufficient.

The inventors have made various investigations with respect to the stabilization of an aqueous solution of an oxidizing agent which consists of ammonium nitrate as a main component and an inorganic chlorate, and found out that, when a specifically limited stabilizer is added to the solution, the decomposition of ammonium nitrate does not occur, and the decomposition of the inorganic chlorate is suppressed even at high temperature, and further the stabilizer-containing aqueous solution of the oxidizing agent is sufficiently stable even in the presence of chloride ions, to accomplish the objects of the present invention.

SUMMARY OF THE INVENTION

The present invention provides a stable aqueous solution-type oxidizing agent composition consisting of an aqueous solution of an oxidizing agent, which consists of ammonium nitrate as a main component and an inorganic chlorate, said aqueous solution containing a water-soluble inorganic phosphate.

DESCRIPTION OF THE PREFERRED EMBODIMENT

The aqueous solution of an oxidizing agent to be used in the present invention is an aqueous solution always containing ammonium nitrate as a main component and an inorganic chlorate. As the inorganic chlorate, use is made of alkali metal salts or alkaline earth metal salts of inorganic chloric acid, and for example, sodium chlorate, potassium chlorate, barium chlorate, strontium chlorate and the like. These chlorates can be used alone or in admixture. In addition to the inorganic chlorate and ammonium nitrate, the aqueous solution of oxidizing agent may occasionally contain nitrates, such as sodium nitrate, calcium nitrate and the like; perchlorates, such as ammonium perchlorate, sodium perchlorate and the like; chlorides, such as sodium chloride and the like; and water-soluble organic substances, such as polyhydric alcohol of mannitol and the like.

The specifically limited stabilizer, which can be used in the present invention, is a water-soluble phosphate, and includes, for example, the following phosphates:

Orthophosphate represented by the general formula $M_3PO_4$, wherein M represents sodium, potassium, magnesium and the like; polyphosphate represented by the general formula $M_{n+2}P_nO_{3n+1}$, wherein n represents an integer of 2, 3, 4 . . . (n=2: pyrophosphate, n=3: tripolyphosphate, and n=4: tetrapolyphosphate), and M represents sodium, potassium, magnesium and the like; metaphosphate represented by the general formula $(MPO_3)_n$, wherein n represents an integer of 3 or 4 (n=3: trimethaphosphate, and n=4: tetrametaphosphate) and M represents sodium, potassium, magnesium, etc.; and the like. In the above described phosphates, a part of sodium, potassium and magnesium represented by M may be substituted by hydrogen.

The above described phosphates are used alone or in admixture.

The amount of each of the above described components can be properly determined depending upon the concentration of ammonium nitrate, the pH of the aqueous solution, the amount of the other substances to be mixed, the strength as an alkali of the water-soluble phosphate, and the like. It is generally preferable that the amount of ammonium nitrate is 58–89.99% by weight (hereinafter, % means % by weight), that of inorganic chlorate is 2–20%, that of water is 8–20%, and that of water-soluble phosphate is 0.01–2%. When the amount of water-soluble phosphate is less than 0.01%, the phosphate cannot exhibit the action as a stabilizer for the aqueous solution of oxidizing agent; while when the amount exceeds 2%, the relative amount of oxidizing agent is small, and hence the action of the oxidizing agent is decreased, and further the action of the stabilizer for the aqueous solution of oxidizing agent is not so improved as compared with the case where the amount of the phosphate is 2%, and the use of more than 2% of the water-soluble phosphate is expensive and is not preferable.

The stable aqueous solution-type oxidizing agent composition of the present invention can be produced, for example, in the following manner.

A given amount of ammonium nitrate and a given amount of water-soluble phosphate are dissolved in a given amount of water at a temperature of 50°-120° C. to form a solution, and a given amount of inorganic chlorate is dissolved in the solution under stirring.

When it is ocassionally intended to add other inorganic oxidizing acid salt, chloride, water-soluble organic substance and the like to the stable aqueous solution-type oxidizing agent composition of the present invention, these compounds or substances are added to the aqueous solution of ammonium nitrate and water-soluble phosphate before the inorganic chlorate is added to the solution.

The stable aqueous solution-type oxidizing agent composition obtained by the above described method is free from the decomposition of ammonium nitrate, and substantially free from the decomposition of inorganic chlorate even at high temperature, and is sufficiently stable even in the presence of chloride ions. Therefore, the stable aqueous solution-type oxidizing agent composition is most suitable to be used as an oxidizer for explosives.

The following examples are given for the purpose of illustration of this invention, and are not intended as limitations thereof. In the examples, "parts" and "%" are indicated by weight basis.

EXAMPLE 1

A stable aqueous solution-type oxidizing agent composition having a compounding recipe shown in the following Table 1 was produced in the following manner.

To 95 parts (9.50%) of water were added 856.8 parts (85.68%) of ammonium nitrate and 0.2 part (0.02%) of disodium hydrogenphosphate, and the resulting mixture was heated to 100° C. to dissolve the nitrate and phosphate in the water. Then, 48 parts (4.80%) of sodium chlorate were added to the solution and dissolved therein to form a stable aqueous solution-type oxidizing agent composition.

The resulting aqueous solution of the oxidizing agent composition was charged into a flask of 500 ml capacity equipped with a cooling tube in order to prevent the evaporation of water, and the flask was placed in an oil bath kept at 100° C. to effect the storage stability test of the aqueous solution.

In the storage stability test, a part of the aqueous solution of the oxidizing agent composition was taken out from the flask at certain time intervals, and the amount of chlorate ion was analyzed by the method of the instant invention. Further, the decomposition rate of the sodium chlorate was determined from the difference between the amount of chlorate ion in the original solution and the amount of chlorate ion in the sample solution.

The decomposition of ammonium nitrate was judged by the presence or absence of ammonium smell.

The chlorate ion was analyzed as follows. Proper amounts of sodium nitrite and an aqueous solution of silver nitrate were added to a sample solution. After the solution was made into nitric acid-acidic, the solution was heated to convert the chlorate ion into chloride ion, and to precipitate the resulting silver chloride. After the precipitate of silver chloride was filtered off, iron (II) ion was added to the filtrate as an indicator, the excess amount of silver nitrate remaining in the filtrate was determined by titrating the amount of filtrate with an aqueous solution of ammonium thiocyanate, and the amount of the chlorate ion was calculated from the reacted amount of silver nitrate.

The above obtained decomposition rate of the chlorate is shown in Table 1. The storage stability test was effected up to 10 days. Even after 10 days, an ammonia smell was not observed and it was ascertained that ammonium nitrated did not decompose.

EXAMPLES 2-5

Stable aqueous solution-type oxidizing agent compositions having a compounding recipe shown in Table 1, wherein the kind and mixing ratio of water-soluble phosphate were changed from those in Example 1, were produced in the same manner as described in Example 1.

The resulting oxidizing agent compositions were subjected to the same storage stability test as described in Example 1. The obtained results are shown in Table 1. It was ascertained that the chlorate and ammonium nitrate did not decompose at all in all the oxidizing agent compositions.

EXAMPLE 6

A stable aqueous solution-type oxidizing agent composition was produced in the same manner as described in Example 1, except that potassium pyrophosphate was used as the water-soluble phosphate in addition to disodium hydrogenphosphate.

The resulting composition was subjected to the same storage stability test as described in Example 1, and it was ascertained that sodium chlorate and ammonium nitrate did not decompose at all. The obtained results are shown in Table 1.

EXAMPLE 7

A stable aqueous solution-type oxidizing agent composition was produced in the same manner as described in Example 1, except that sodium chloride was added to the reaction system.

The resulting composition was subjected to the same storage stability test as described in Example 1, and it was ascertained that ammonium nitrate did not decompose at all. The obtained results are shown in Table 1.

EXAMPLE 8

A stable aqueous solution-type oxidizing agent composition having a compounding recipe shown in Table 1, wherein a polyhydric alcohol of mannitol was added to the compounding recipe of Example 1, was produced in the same manner as described in Example 1.

The resulting composition was subjected to the same storage stability test as described in Example 1, and it was ascertained that sodium chlorate and ammonium nitrate did not decompose at all. The obtained results are shown in Table 1.

TABLE 1

| Example No. | | | 1 | 2 | 3 | 4 | 5 | 6 | 7 | 8 |
|---|---|---|---|---|---|---|---|---|---|---|
| Compounding recipe (%) | Ammonium nitrate | | 85.68 | 85.60 | 74.60 | 65.80 | 60.20 | 86.00 | 60.20 | 69.20 |
| | Sodium nitrate | | — | — | 4.10 | — | — | — | — | — |
| | Calcium nitrate | | — | — | — | 22.20 | — | — | — | — |
| | Sodium chlorate | | 4.80 | 4.80 | — | — | 19.40 | 4.60 | 18.40 | 15.30 |
| | Potassium chlorate | | — | — | 9.90 | — | — | — | — | — |
| | Barium chlorate | | — | — | — | 2.40 | — | — | — | — |
| | Water | | 9.50 | 9.50 | 10.90 | 8.60 | 18.70 | 9.30 | 18.40 | 10.70 |
| | Sodium chloride | | — | — | — | — | — | — | 1.30 | — |
| | Mannitol | | — | — | — | — | — | — | — | 3.80 |
| | Disodium hydrogenphosphate | | 0.02 | — | — | — | — | 0.05 | — | 1.00 |
| | Magnesium hydrogenphosphate | | — | 0.10 | — | — | — | — | — | — |
| | Potassium pyrophosphate | | — | — | 0.50 | — | — | 0.05 | — | — |
| | Sodium tripolyphosphate | | — | — | — | 1.00 | — | — | — | — |
| | Sodium metaphosphate | | — | — | — | — | 1.70 | — | 1.70 | — |
| Storage stability | Decomposition percentage of chlorate at 100° C. (%) | 1 day | 0 | 0 | 0 | 0 | 0 | 0 | 0 | 0 |
| | | 3 days | 0 | 0 | 0 | 0 | 0 | 0 | 0.1 | 0 |
| | | 5 days | 0.1 | 0 | 0 | 0 | 0 | 0 | 0.1 | 0 |
| | | 10 days | 0.2 | 0 | 0 | 0 | 0 | 0 | 0.2 | 0 |
| | Ammonia smell (10 days) | | none | none | none | none | none | none | none | none |

COMPARATIVE EXAMPLES 1-4

Aqueous solution-type oxidizing agent compositions having a compounding recipe shown in the following Table 2, wherein disodium hydrogenphosphate used in Example 1 was not used, were produced in the same manner as described in Example 1.

The resulting compositions were subjected to the same storage stability test as described in Example 1. The obtained results are shown in Table 2.

COMPARATIVE EXAMPLE 5

An aqueous solution-type oxidizing agent composition having a compounding recipe shown in Table 2, wherein sodium metaphosphate used in Example 7 was not used, was produced in the same manner as described in Example 7.

The resulting composition was subjected to the same storage stability test as described in Example 1. The obtained results are shown in Table 2.

COMPARATIVE EXAMPLES 6 AND 7

Aqueous solution-type oxidizing agent compositions having a compounding recipe shown in Table 2, wherein sodium carbonate or sodium hydroxide was used in place of disodium hydrogenphosphate used in Example 1 respectively, were produced in the same manner as described in Example 1.

Immediately after the production of this composition, the, ammonia smell was violent. It was ascertained that ammonium nitrate had decomposed.

The resulting compositions were subjected to the same storage stability test as described in Example 1. The obtained results are shown in Table 2.

COMPARATIVE EXAMPLE 8

An aqueous solution-type oxidizing agent composition was produced in the same manner as described in Example 7, except that sodium carbonate was used in place of sodium metaphosphate. Immediately after the production, of this composition the, ammonia smell was violent. It was ascertained that ammonium nitrate had decomposed.

The resulting composition was subjected to the same storage stability test as described in Example 1. The obtained results are shown in Table 2.

TABLE 2

| Comparative example No. | | | 1 | 2 | 3 | 4 | 5 | 6 | 7 | 8 |
|---|---|---|---|---|---|---|---|---|---|---|
| Compounding recipe (%) | Ammonium nitrate | | 85.70 | 75.10 | 65.80 | 61.90 | 61.90 | 84.90 | 85.68 | 60.20 |
| | Sodium nitrate | | — | 4.10 | — | — | — | — | — | — |
| | Calcium nitrate | | — | — | 23.20 | — | — | — | — | — |
| | Sodium chlorate | | 4.80 | — | — | 19.40 | 19.40 | 4.70 | 4.80 | 18.40 |
| | Potassium chlorate | | — | 9.90 | — | — | — | — | — | — |
| | Barium chlorate | | — | — | 2.40 | — | — | — | — | — |
| | Water | | 9.50 | 10.90 | 8.60 | 18.70 | 18.70 | 9.40 | 9.50 | 18.40 |
| | Sodium chloride | | — | — | — | — | 1.30 | — | — | 1.30 |
| | Sodium carbonate | | — | — | — | — | — | 1.00 | — | 1.70 |
| | Sodium hydroxide | | — | — | — | — | — | — | 0.02 | — |
| Storage stability | Decomposition percentage of chlorate at 100° C. (%) | 1 day | 2.4 | 2.6 | 0.2 | 0.2 | 1.5 | 0 | 0.1 | 0.1 |
| | | 3 days | 100 | 100 | 6.6 | 5.5 | 100 | 0.2 | 0.6 | 0.4 |
| | | 5 days | — | — | 100 | 100 | — | 0.5 | 2.2 | 2.0 |
| | | 10 days | — | — | — | — | — | 5.4 | 11.0 | 10.8 |
| | Ammonia smell (10 days) | | none | none | none | none | none | strong* | strong* | strong* |

*Violent ammonia smell even just after the production

The results of the above described Examples and Comparative examples will be explained in detail. In the aqueous solution-type oxidizing agent compositions containing no water-soluble phosphate (Comparative examples 1-4), although ammonium nitrate does not decompose up to 10 days in a storage stability test under a condition of 100° C., the inorganic chlorate decomposes completely after only 3 to 5 days. On the contrary, in the stable aqueous solution-type oxidizing agent compositions containing a water-soluble phosphate according to the present invention (Examples 1-6 and 8), ammonium nitrate does not decompose at all, and further the inorganic chlorate does not decompose at all or decomposes in a very small amount (0.2% after 10 days) under the same condition as described above.

In the aqueous solution-type oxidizing agent compositions using a commonly known alkali substance as a stabilizer (Comparative examples 6 and 7), the ammonia smell is violent just after the production, and further the ammonia smell is strong throughout the storage stability test. That is, it is clear that ammonium nitrate has decomposed. Moreover, the decomposition percentage of the inorganic chlorate is very large and is about 5-10% after 10 days.

In the aqueous solution-type oxidizing agent composition containing chloride ion (Comparative example 5), although the decomposition of ammonium nitrate does not occur during the storage stability test, the inorganic chlorate has completely decomposed only after 3 days. On the contrary, in the stable aqueous solution-type oxidizing agent composition containing a water-soluble phosphate of the present invention (Example 7), the decomposition percentage of the inorganic chlorate is only 0.2% after 10 days. In the aqueous solution-type oxidizing agent composition containing a commonly known stabilizer (Comparative example 8), the decomposition percentage of the inorganic chlorate is as large as 10.8% after 10 days, and further the decomposition of ammonium nitrate is observed.

As described above, in the stable aqueous solution-type oxidizing agent composition according to the present invention, ammonium nitrate does not decompose, and further the decomposition of inorganic chlorate does not occur at all or is very small even at high temperature, and moreover the composition is satisfactorily stable even in the presence of chloride ions.

We claim:

1. A stable aqueous solution-type oxidizing agent composition consisting of an aqueous solution of an oxidizing agent, which consists of 58-89.99% by weight of ammonium nitrate as a main component and 2-20% by weight of an inorganic chlorate, 8-20% by weight of water and 0.01-2% by weight of a water-soluble inorganic phosphate.

2. The stable aqueous solution-type oxidizing agent composition according to claim 1, wherein said water-soluble inorganic phosphate comprises one of the group consisting essentially of phosphate formed from orthophosphoric acid, poly-phosphoric acid, or metaphosphoric acid.

3. The stable aqueous solution-type oxidizing agent composition according to claim 2, wherein said inorganic chlorate is a chlorate of alkali metal or alkaline earth metal.

4. The stable aqueous solution-type oxidizing agent composition according to claim 2, wherein said phosphate is a phosphate of alkali metal or alkaline earth metal.

* * * * *